United States Patent [19]

Nelson

[11] Patent Number: 4,664,042

[45] Date of Patent: May 12, 1987

[54] METHOD OF DECREASING ASH FOULING

[75] Inventor: H. Wharton Nelson, West Hartford, Conn.

[73] Assignee: Combustion Engineering, Inc., Windsor, Conn.

[21] Appl. No.: 460,223

[22] Filed: Jan. 24, 1983

[51] Int. Cl.[4] ..... F23D 1/00

[52] U.S. Cl. ..... 110/347; 110/263; 110/265

[58] Field of Search ..... 122/1 A; 110/347, 261, 110/263, 265

[56] References Cited

U.S. PATENT DOCUMENTS

| | | | |
|---|---|---|---|
| 2,259,967 | 10/1941 | Vogel-Jorgensen | 110/263 |
| 2,867,182 | 1/1959 | Crites | 110/347 |
| 3,229,651 | 1/1966 | Wasp | 110/347 |
| 4,150,631 | 4/1979 | Frey et al. | 110/265 |
| 4,173,189 | 11/1976 | Cooper | 110/263 |
| 4,223,615 | 9/1980 | Breen et al. | 110/347 |
| 4,246,853 | 1/1981 | Mehta | 110/263 |
| 4,294,178 | 10/1981 | Bono et al. | 110/265 |
| 4,332,207 | 6/1982 | Blaskowski et al. | 110/347 |

*Primary Examiner*—Henry C. Yuen

*Attorney, Agent, or Firm*—Arthur E. Fournier, Jr.

[57] ABSTRACT

A furnace burns coal where the coal is decreased to a fine size to expand the surface of the carbon in the coal to a predetermined amount of free oxygen from air to militate against reduction of alkali compounds in the coal. Further, the temperature of the combustion is controlled to a predetermined maximum by recirculation of cooled flue gas to complete the control over the alkali compounds in the coal and prevent the formation of tube-fouling silicates.

4 Claims, 1 Drawing Figure

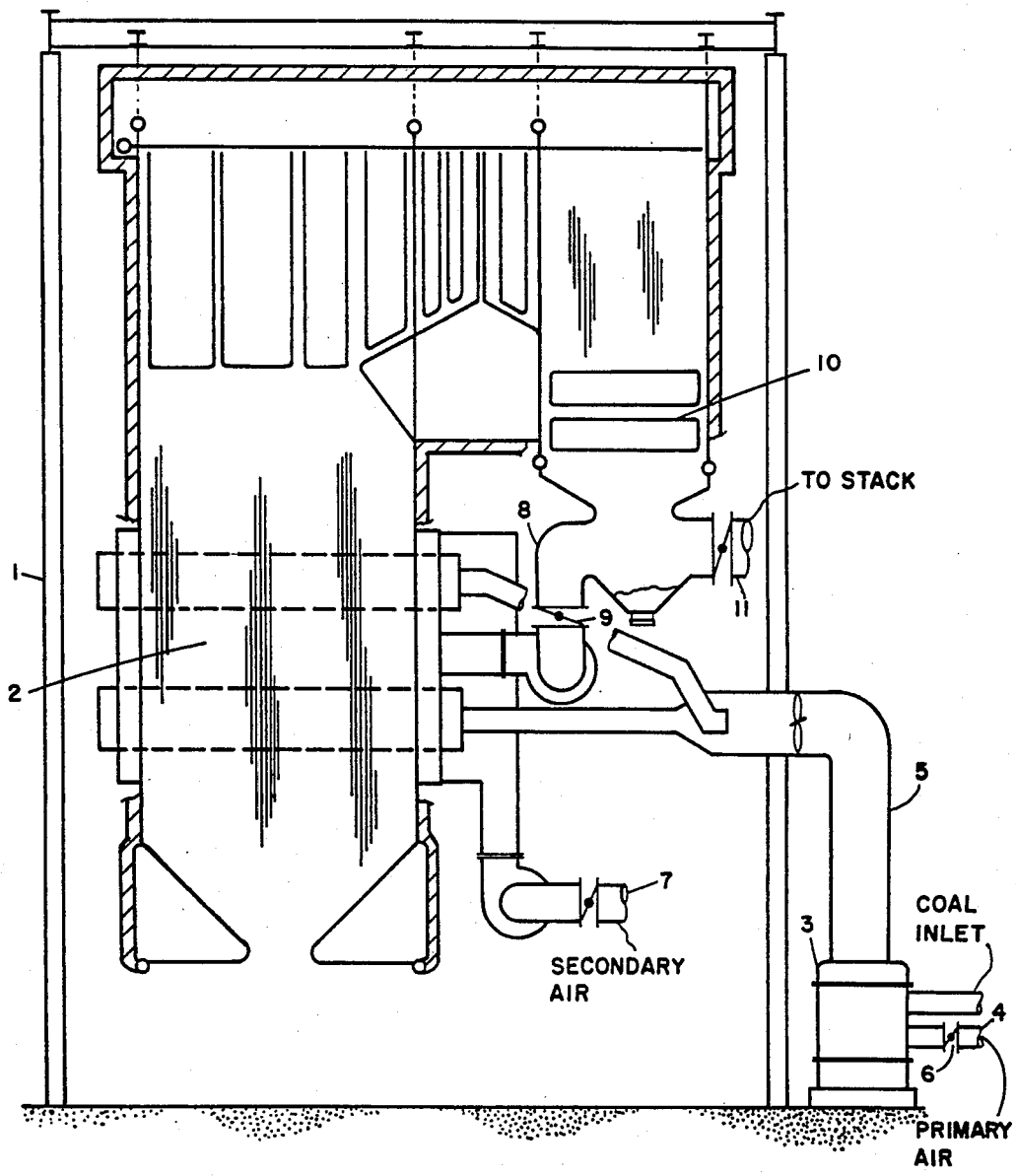
10
TO STACK
8
1
9
11
2
5
7
COAL
INLET
3
SECONDARY
AIR
4
6
PRIMARY
AIR

METHOD OF DECREASING ASH FOULING

TECHNICAL FIELD

The present invention relates to the combustion of fouling-type coals which have a high volatile alkali content with a process to minimize ash fouling of steam-cooled tubes in the furnace. The invention further relates to controlling the size of fouling-type coal particles, their amount of primary combustion air, and the temperature of their combustion in order to minimize the production of sodium metal vapor which, in subsequent reactions results in the formation of low-melting silicates which promote ash fouling.

BACKGROUND ART

In young coals from cellulosic plant material, the acids formed, such as humic, combined with alkalies from the ground water to form active compounds from which the alkalies are volatilized on burning. When the coal is thermally decomposed during combustion, these active alkalies first become rather large solid particles of sodium oxide ($Na_2O$) which remain firmly imbedded in the carbon residue of the thermally decomposed organic acids. The result of the first stage of combustion on such mineral constituents of the coal is expressed by the following equation:

$$\text{Na humate} \xrightarrow{\text{heat}} Na_2O\ (\text{massive}) + C + \text{combustible gases.} \quad (1)$$

The sodium oxide so produced is a relatively refractory compound with a high boiling point of approximately 2300° F. Sodium oxide is, therefore, difficult to volatilize from the carbon matrix formed in this initial, low-temperature stage of coal combustion. By contrast, the sodium metal vapor next formed by "reduction" of sodium oxide with carbon in the second stage of coal combustion has a boiling point of only 1620° F., which is 680° F. lower than that of parent sodium oxide. The fate of the alkali ash constituent in this second, higher temperature stage of combustion is expressed by the following equation: (2) $Na_2O$ (massive)$+C \rightarrow Na_2$(-vapor)$+CO$ (gas). Note that "reduction" is a chemical reaction in which oxygen is stripped from a compound by a reducing agent. In the above case, sodium oxide has been reduced to sodium metal vapor and the carbon has been oxidized to carbon monoxide.

At normal high furnace temperatures, the highly volatile sodium metal vapor therefore "spews out" forcefully from the burning fuel particle into the surrounding air envelope as soon as it is formed. The sodium metal vapor is highly reactive with air and thus burns quickly to form sodium oxide fume. This result is expressed by the following equation: (3) $Na_2$ (vapor)$+\frac{1}{2}O_2 \rightarrow Na_2O$ (fume). This fume is a very fine, submicron sized dust which is the normal state of division of the solid ash particles from burning a metal vapor. The sodium oxide fume from equation 3 is radically different from the initial massive form of sodium oxide produced by thermal decomposition of sodium humate represented by equation 1. For instance, the fume exists as a chemically reactive aerosol in the flue gas stream. Its particles have a very high specific surface area and readily react with the surface of the initially powdery silica-rich ash deposits on boiler tubes to form sticky ash-bonding alkali silicates. The larger crystalline sodium oxide particles from equation 1, by contrast, are not dispersed in the flue gas stream since they are anchored in the fuel particle by the carbon matrix until the key reduction reaction 2 occurs.

When the third stage of combustion is reached and a sodium oxide aerosol in flue gas is produced, it will sweep over the initially powdery ash deposits on the tubes. This deposition of the sodium compound from the aerosol will form a surface coating of sticky, low-melting ash-bonding alkali silicates on each silica particle. This result is represented by the following generic equation: (4) $Na_2O$ (fume)$+SiO_2$(in ash)$\rightarrow Na_2SiO_3$ (silicate glass).

Some of the young coals, such as lignite and subbituminous, found in at least the Western United States, have a sufficiently high alkali (sodium) content to give the rapid ash-fouling problem. When these coals are burned in utility boilers, the resulting ash sticking to heat transfer surfaces quickly builds up in thick insulating layers and is very expensive to remove. Therefore, these problem coals cause prohibitive ash fouling and repeated unscheduled shutdowns for manual removal. Attempts to overcome this problem have been expedient, often mechanical, and of limited effectiveness. Worse, the symptoms, rather than the "disease", have been attacked.

First, the furnace design parameters such as volumetric heat release rate and furnace (flue gas) outlet temperatures have been descreased in an effort to remedy this fouling. Second, elaborate systems for steam and water sootblowing have also been applied. These approaches have been in the nature of a quick fix, temporarily effective, but they have constituted no fundamental solution.

The relationship between the presence of active alkalies in coal which are soluble in dilute acid and are readily volatilized upon combustion, and the resulting fouling of furnace surfaces has been well established by fundamental research. Therefore, a third solution to the fouling problem has been sought through leaching the soluble alkali compounds from the finely ground coal using dilute aqueous acids. Again, this solution has proved impractical because of its expense and the fact that excessive water remained in the coal.

The fourth solution suggested was the use of an "alkali-getter". Specifically, finely-divided silica or alumina was proposed as an additive to combine with the volatilized alkali and form a high-melting end product in ash deposited on the tube surfaces. However, there has been no development of this solution to bring it up to a commercial level.

A fifth approach has been hinted at by physically absorbing the molten ingredient(s) from an ash deposit which cause the ash particles to adhere to one another and to the tube surface, by use of a porous siliceous type additive like diatomaceous earth.

The searches for a practical solution to the ash fouling problem have even included coal blending to eliminate the problem. This has good troublesome and expensive. The foregoing approaches are examples of measures which have been and are now being studied to alleviate the serious ash-fouling problems with high sodium coals.

To summarize the ash-fouling mechanism, the basic function of the key chemical reduction reaction 2, and sequential reaction 3, is the creation of an aerosol of highly reactive sodium oxide fume in the flue gas which generates the low-melting sticky "glue" in deposited powdery ash (be reaction 4) which bonds it to the tubes and the ash particles to one another. Metallic sodium vapor, the precursor of this "glue", can be formed only if all three of the following conditions are maintained during the coal combustion process: (a) a highly reducing (oxygen deficient) atmosphere at the coal particle-to-gas interface, (b) a high enough temperature to effect reaction 2, and (c) a long enough reaction time. Under equilibrium conditions this reaction is most likely to occur above 1926° F., the threshold temperature. Sodium metal vapor production accelerates rapidly as the reaction temperature increases above this value when carbon is present. Changes in the coal-firing method which both increase the initial contact of fuel with free oxygen (to decrease the intensity of and exposure time to reducing conditions) and also control the burning temperature to below a predetermined maximum value will decrease the rate and amount of metallic sodium vapor formed and the resulting ash fouling.

DISCLOSURE OF THE INVENTION

The present invention contemplates the combustion of coals having a high dilute acid soluble alkali content in a process which will decrease the reduction of sodium oxide ($Na_2O$) and the subsequent formation of metallic sodium which would form sticky ash-fouling compounds with silica.

The invention further contemplates minimizing the chemical reduction of alkali oxides in coal having a high alkali content by decreasing the size of the pulverized coal particles and increasing the primary air (i.e. free oxygen) to hasten their combination and thereby inhibit the reduction of the alkali oxides which requires a hot, oxygen-deficient atmosphere and sufficient contact time with the carbon of the coal.

The invention further contemplates recirculating cooled flue gas of combustion in an amount sufficient to maintain the temperature of combustion below a predetermined maximum value to further inhibit the formation of sodium metal vapor and resulting bonded ash deposits during combustion. Such temperature control will also decrease slag formation on the lower furnace waterwall tubes.

Other objects, advantages and features of this invention will become apparent to one skilled in the art upon consideration of the written specification, appended claims, and attached drawing.

BRIEF DESIGNATION OF THE DRAWING

The drawing is a schematic of the main components of a steam generator illustrating control of the factors required to embody the invention.

TERMS AND TECHNOLOGY

The fouling of high temperature furnace steam-cooled tubes, like those in the superheater and reheater, is distinguished from the slagging of waterwall tubes. Fouling is caused by the accretion of masses of bonded ash in which the individual ash particles are cemented on each other and to steam-cooled tube surfaces of the furnace by a thin surface layer of molten compounds coating each particle. These interstitial low-melting "glue-like" compounds are formed in situ by chemical reactions of the deposited initially powdery siliceous coal ash on the tubes with reactive particulate material (alkali oxide fume) suspended in the flue gas which constantly sweeps over the windward ash-collecting surface of the tubes. Total fusion of the deposit is not achieved in fouling. Slagging, by contrast, is produced by total fusion of the ash into a sticky vitreous mass which accumulates on the front surface of the lower-temperature, waterwall tubes. This slagging occurs in a higher gas temperature zone of the furnace, such as on waterwall tubes in the combustion zone. It is principally the fouling phenomenon with which this present disclosure is concerned.

To alleviate ash fouling in the combustion of coals having a high dilute acid soluble alkali content, the coal must be combusted in a manner to decrease or prevent the reduction of sodium oxide ($Na_2O$) formed in the initial stage of combustion. This decrease of reduction interrupts the chemical reaction chain which would otherwise produce sticky siliceous compounds which bond the ash to the steam-cooled tubes.

BEST MODE FOR CARRYING OUT THE INVENTION

Under the concept of the present invention, the surface area of coal will be expanded to facilitate its rapid combination with free oxygen of the additional primary combustion air in preference to the bound oxygen of the alkali oxide in coal ash under reducing conditions. At the same time, the concept includes controlling the temperature of combustion at a lower level nearer the threshold value at which the sodium oxide formed in the initial stage of combustion is actively reduced. The result of controlling these factors will be a decrease of the release of the alkali metal as a vapor which would, by subsequent reactions, readily combine with silica of the powdery ash deposits on tubes to cause tenacious ash bonding. The drawing illustrates the structural embodiment of the necessary control of the coal particle size, the availability of free oxygen, and the recirculation of cooled flue gas.

The drawing is offered to illustrate how the method of the invention is implemented with structure. Three basic elements are controlled. First, the size of the coal is regulated so that 90% of the pulverized coal will pass through a 200 mesh screen. Second, the amount of primary air (which provides the free oxygen available to combine initially with the carbon of the coal) is regulated. Third, the temperature of the combustion process is regulated by the amount of recirculated inert flue gas passed into the combustion chamber. These three elements are controlled within the structure of furnace 1.

Combustion chamber 2 combines the pulverized coal from pulverizer 3 with the oxygen of combustion air. There are two sources of combustion air. First, the so-called primary air is supplied through a conduit 4. This primary air entrains the coal pulverized by pulverizer 3 and the mixture is delivered to the combustion chamber through conduit 5. Regulation of the amount of this primary air is indicated by a control damper 6 in conduit 4. Additional air is supplied by a conduit 7 and termed secondary air. The total amount of free oxygen available to the combustion process is a balance between the amount of secondary air through conduit 7 and primary air through conduit 4; regulation is represented by damper 6 in the primary air conduit 4 and by damper 7 in the secondary air conduit. In all events, the amount if free oxygen available to combine initially with the carbon of the pulverized coal is controlled by damper 6 in conduit 4.

Control of the ultimate temperature of the combustion process in chamber 2 is represented by recirculation of the inert flue gas passed through conduit 8. Control over the proportion of this recirculated inert gas is represented by damper 9 in conduit 8. Therefore, the three elements of control are represented by the operation of pulverizer 3, the setting of damper 6, and the setting of damper 9.

The other conventional elements of furnace 1 are apparent from the drawing. From the combustion chamber 2, the products of combustion ascend to economizer 10 and are passed down to exit from conduit 11. Part of the inert flue gases, cooled by the water walls, superheater, reheater, and finally economizer 10, are then available in conduit 8 to function as the control over the ultimate combustion temperature in chamber 2.

With the coal ground to the size which will rapidly combine with the free oxygen made available, it is necessary to regulate the otherwise "run-away" temperature of this combustion to a lower level nearer the threshold temperature of 1926° F. The specific temperature selected, or predetermined, will be one which permits economic heat transfer. For instance, a flame temperature of about 2500° F., instead of a normal 3000° F., might be considered, but the exact temperature would depend on the volatile sodium content of the coal and the firing rate of the boiler. Properly regulated in amount, the flue gas will maintain the combustion temperature at the level which will decrease both slag and the reduction of the sodium oxide with the inevitable release of the sodium as a vapor which would otherwise work its undersirable combination with the silica of the initially powdery ash deposits on the steam-cooled tubes downstream.

Recapitulation

In broad outline, the present invention is embodied in the altered combustion of coal having a high alkali content. The principal key is found in the modification of combustion reactions which would normally reduce the alkali compounds in the coal and release the alkali metallic component in a form which will readily combine with silica by subsequent successive reactions. A closer view of the novel combustion conditions is had when the coal is decreased in particle size so its carbon content will more quickly combine with extra free oxygen available in the higher proportion of primary air, rather than the oxygen bound up with the alkali. An additional factor of importance is the control of the overall combustion temperature to additionally discourage the reduction of the alkali oxide. Thus, control of coal particle size, excess free oxygen availability to the flame envelope, and combustion temperature moderation by recirculated cool flue gas are all factors which control the release of the alkali metal from the alkali oxide in coal ash. Therefore, the metal of the oxide does not find its way to combination with silica available in the powdery ash deposited on tube surfaces. The silicate is not formed and is, therefore, not available to stick ash particles together and to the steam-cooled tubes of the furnace.

From the foregoing, it will be seen that this invention is one well adapted to attain all of the ends and objects hereinabove set forth, together with other advantages which are obvious and inherent to the method.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A method for burning coal having a high dilute acid soluble alkali content to minimize the formation of ash-fouling compounds, including, grinding the coal to particle sizes whereby at least 90% of the particles will pass through a 200 mesh screen, supplying enough primary and/or secondary air containing free oxygen to the combustion to minimize reducing conditions for alkali oxide formed in the initial stage of combustion, and supplying enough inert gaseous medium of lower temperature to the combustion process to maintain the combustion temperature down nearer the threshold temperature of alkali oxide reduction.

2. The method of claim 1, in which, the cooled gaseous medium is recirculated products of combustion.

3. The method of claim 2, in which, the cooled products of combustion maintain the temperature of the combustion process below about 2500° F.

4. The method of claim 3, in which, the alkali metal is sodium.

* * * * *